US007340905B2

(12) United States Patent
An

(10) Patent No.: US 7,340,905 B2
(45) Date of Patent: Mar. 11, 2008

(54) REFRIGERATOR AND METHOD OF MAKING SHAVED ICE

(75) Inventor: Jae Koog An, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 259 days.

(21) Appl. No.: 11/235,292

(22) Filed: Sep. 27, 2005

(65) Prior Publication Data

US 2006/0070386 A1 Apr. 6, 2006

(30) Foreign Application Priority Data

Sep. 30, 2004 (KR) ..... 10-2004-0078096
Sep. 8, 2005 (KR) ..... 10-2005-0083474

(51) Int. Cl.
*F25C 5/02* (2006.01)

(52) U.S. Cl. ..... 62/66; 62/233; 62/320; 241/DIG. 17

(58) Field of Classification Search ..... 62/320, 62/344, 66, 233; 241/DIG. 17
See application file for complete search history.

(56) References Cited

U.S. PATENT DOCUMENTS 4,276,750 A * 7/1981 Kawasumi ..... 62/137
4,745,773 A * 5/1988 Ando ..... 62/320
7,003,974 B1 * 2/2006 Brooks ..... 62/320
7,111,473 B2 * 9/2006 Chung et al. ..... 62/320

FOREIGN PATENT DOCUMENTS

| | | |
|---|---|---|
| JP | 08-210976 | 8/1996 |
| KR | 10-1999-0040637 | 6/1999 |
| KR | 10-2001-0105953 | 11/2001 |

* cited by examiner

*Primary Examiner*—William E. Tapolcai
(74) *Attorney, Agent, or Firm*—Staas & Halsey LLP

(57) ABSTRACT

A refrigerator and a method of making shaved ice by controlling a period during which ice is fed into an ice-shaving compartment, thereby preventing ice from overflowing the ice-shaving compartment and preventing the ice-shaving compartment from being broken due to an excessive amount of ice. The method of making shaved ice comprises feeding cubed ice stored in an ice-storing unit mounted in a freezing compartment to a shaved ice-making unit mounted at a discharge port side of the ice-storing unit though an ice-feeding unit to make shaved ice, setting a driving time for the shaved ice-making unit, and setting a driving time for the ice-feeding unit. The driving time for the shaved ice-making unit is longer than the driving time for the ice-feeding unit.

13 Claims, 6 Drawing Sheets

REFRIGERATOR AND METHOD OF MAKING SHAVED ICE

CROSS-REFERENCE TO RELATED APPLICATION

This application claims the benefit of Korean Patent Application No. 2004-78096, filed on Sep. 30, 2004 and Korean Patent Application No. 2005-83474, filed on Sep. 8, 2005 in the Korean Intellectual Property Office, the disclosure of which is incorporated herein by reference.

BACKGROUND OF THE INVENTION

1. Field of the Invention

The present invention relates to a refrigerator and a method of making shaved ice, and, more particularly, to a refrigerator and a method of making shaved ice that is capable of controlling a feeding rate of ice, whereby the ice is fed in the optimum quantity necessary to make shaved ice.

2. Description of the Related Art

Generally, a refrigerator includes a refrigerating compartment and a freezing compartment, which are operated at different temperatures. Some of the cool air generated from an evaporator of the freezing compartment is supplied to the refrigerating compartment, or an additional evaporator is disposed in the refrigerating compartment to lower the temperature in the refrigerating compartment. Therefore, foods are maintained in a fresh state in the refrigerator.

Recently, there has been increasingly used a refrigerator with an ice/water dispenser that allows cold water or ice to be taken out of the refrigerator without opening a door of the refrigerator, as a quality and a capacity of the refrigerator is increased. There has also been proposed another refrigerator with an ice shaver to shave cubed ice made in the freezing compartment into shaved ice, and then discharge the shaved ice out of the freezing compartment, which eliminates the necessity of an additional ice-shaving unit to make ice water.

The ice shaver of the refrigerator is disposed under the discharge port of an ice bucket to store cubed ice made by an ice shaver, and the cubed ice discharged from the ice bucket is shaved into shaved ice by the ice shaver. The ice bucket has a spiral feeding unit to feed the stored ice to the discharge port. The feeding unit is connected to an ice-feeding motor, which is disposed at the rear of the ice bucket. In the ice shaver is defined an ice-shaving compartment. The ice-shaving compartment has an ice shaving cutter and a discharge port. Cubed ice discharged from the ice bucket is shaved into shaved ice by the ice-shaving cutter, and the shaved ice is discharged through the discharge port. To the ice shaver is connected to a shaved ice-making motor to drive the ice shaver. In FIG. 1, a method of making shaved ice includes in operation 10, using a control unit to determine whether a shaved ice-making signal is input when a user pushes a shaved ice-making button to make ice water. When it is determined in operation 10, that the shaved ice-making signal is input, the process moves to operations 20 and 30, where the control unit outputs a control signal to a shaved ice-making motor and an ice-feeding motor to drive the shaved ice-making motor and the ice-feeding motor.

The ice-feeding motor feeds cubed ice in the ice bucket to an ice-shaving compartment, where the cutter disposed in the ice-shaving compartment is operated by means of the shaved ice-making motor to shave the fed cubed ice into shaved ice. The shaved ice is discharged out of the ice-shaving compartment through the discharge port.

From operation 30, the process moves to operation 40, where the control unit determines whether a predetermined amount of shaved ice has been made. When it is determined in operation 40, that the predetermined amount of shaved ice has been made, the process moves to operation 50, where the control unit outputs a stop signal to the shaved ice-making motor and the ice-feeding motor, and the shaved ice-making motor and the ice-feeding motor are stopped.

As shown in FIG. 2, in the conventional method of making shaved ice, the shaved ice-making motor and the ice-feeding motor are operated at the same time when the shaved ice-making signal is input to the shaved ice-making motor and the ice-feeding motor, and the shaved ice-making motor and the ice-feeding motor are stopped at the same time when the predetermined amount of shaved ice has been made.

Other ice shavers for refrigerators are disclosed in detail in Korean Unexamined Patent Publication No. 1999-40637 and Korean Registered Patent Publication No. 10-360863.

In the conventional method of making shaved ice, however, the ice-feeding motor is operated simultaneously when the shaved ice-making motor is operated. As a result, ice is continuously fed to the ice-shaving compartment, and therefore, the amount of the ice is excessively increased. The excessive amount of ice may overflow the ice-shaving compartment, or may even break the ice shaver.

Furthermore, a large amount of ice is left in the ice shaver after the shaved ice has been made, since the ice is continuously fed until the making of the shaved ice is completed. As a result, the ice left in the ice shaver may mass into a lump, or the ice left in the ice shaver may thaw into water, which may drop out of the refrigerator.

SUMMARY OF THE INVENTION

Accordingly, it is an aspect of the present invention to provide a refrigerator and a method of making shaved ice that is capable of controlling a feeding period during which ice is fed into an ice shaver, thereby preventing ice from overflowing the ice shaver and preventing the ice shaver from being broken due to an excessive amount of ice.

Additional aspects and/or advantages of the invention will be set forth in part in the description which follows and, in part, will be apparent from the description, or may be learned by practice of the invention.

The foregoing and/or other aspects of the present invention are achieved by providing a refrigerator and a method of making shaved ice, capable of minimizing an amount of ice left in the ice shaver after shaved ice has been made, thereby preventing the ice left in the ice shaver from massing into a lump, or preventing the ice left in the ice shaver from thawing into water, which may drop out of the refrigerator.

It is an aspect of the present invention to provide a method of making shaved ice including feeding cubed ice stored in an ice-storing unit mounted in a freezing compartment to a shaved ice-making unit mounted at a discharge port side of the ice-storing unit though an ice-feeding unit to make shaved ice, the method further including setting a driving time for the shaved ice-making unit, and setting a driving time for the ice-feeding unit, wherein the driving time for the shaved ice-making unit is longer than the driving time for the ice-feeding unit.

The method further includes performing a controlling operation such that the ice-feeding unit is stopped earlier than the shaved ice-making unit.

The method further includes further driving the shaved ice-making unit for a predetermined period after the ice-feeding unit is stopped.

The method further includes repeatedly driving and stopping the ice-feeding unit while driving the shaved ice-making unit continuously.

The method further includes driving the ice-feeding unit for a predetermined first period, and then stopping for a predetermined second period, while driving the shaved ice-making unit continuously, thereby repeatedly driving and stopping the ice-feeding unit.

The method further includes further driving the shaved ice-making unit for a predetermined third period after the predetermined period elapses to make cubed ice.

The method further includes stopping the ice-feeding unit after the ice-feeding unit is driven for a predetermined number of times.

The method further includes further driving the shaved ice-making unit for a predetermined third period after the predetermined period elapses to make cubed ice.

It is another aspect of the present invention to provide a method of making shaved ice including feeding cubed ice stored in an ice-storing unit mounted in a freezing compartment to a shaved ice-making unit mounted at a discharge port side of the ice-storing unit though an ice-feeding unit to make shaved ice, the method further including driving the shaved ice-making unit for a predetermined period, and controlling the ice-feeding unit such that the ice-feeding unit is repeatedly driven and stopped for the predetermined period.

The method further includes driving the ice-feeding unit for a predetermined first period, and then stopping for a predetermined second period, while driving the shaved ice-making unit, thereby repeatedly driving and stopping the ice-feeding unit for the predetermined period.

The method further includes immediately stopping the ice-feeding unit, without stopping the ice-feeding unit for the predetermined second period, after the ice-feeding unit is driven for a predetermined number of times.

It is another aspect of the present invention to provide a refrigerator including an ice shaver mounted in a freezing compartment to make ice, an ice-storing unit to store the ice made by the ice shaver, an ice-feeding unit to feed the ice stored in the ice-storing unit to the outside of the ice-storing unit, a shaved ice-making unit to receive the ice from the ice-feeding unit and to make the ice into shaved ice, and a control unit to perform a controlling operation such that the shaved ice-making unit is driven for a longer period than the ice-feeding unit.

The control unit performs a controlling operation such that the ice-feeding unit is stopped earlier than the shaved ice-making unit.

The control unit performs a controlling operation such that the ice-feeding unit is driven for a predetermined first period, and is then stopped for a predetermined second period, while the shaved ice-making unit is driven, the ice-feeding unit being repeatedly driven and stopped.

The control unit drives the shaved ice-making unit for a predetermined period, drives the ice-feeding unit for a predetermined first period, and then stops the ice-feeding unit for a predetermined second period, the ice-feeding unit being repeatedly driven and stopped for the predetermined period, and further drives the shaved ice-making unit for a predetermined third period after the predetermined period elapses.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
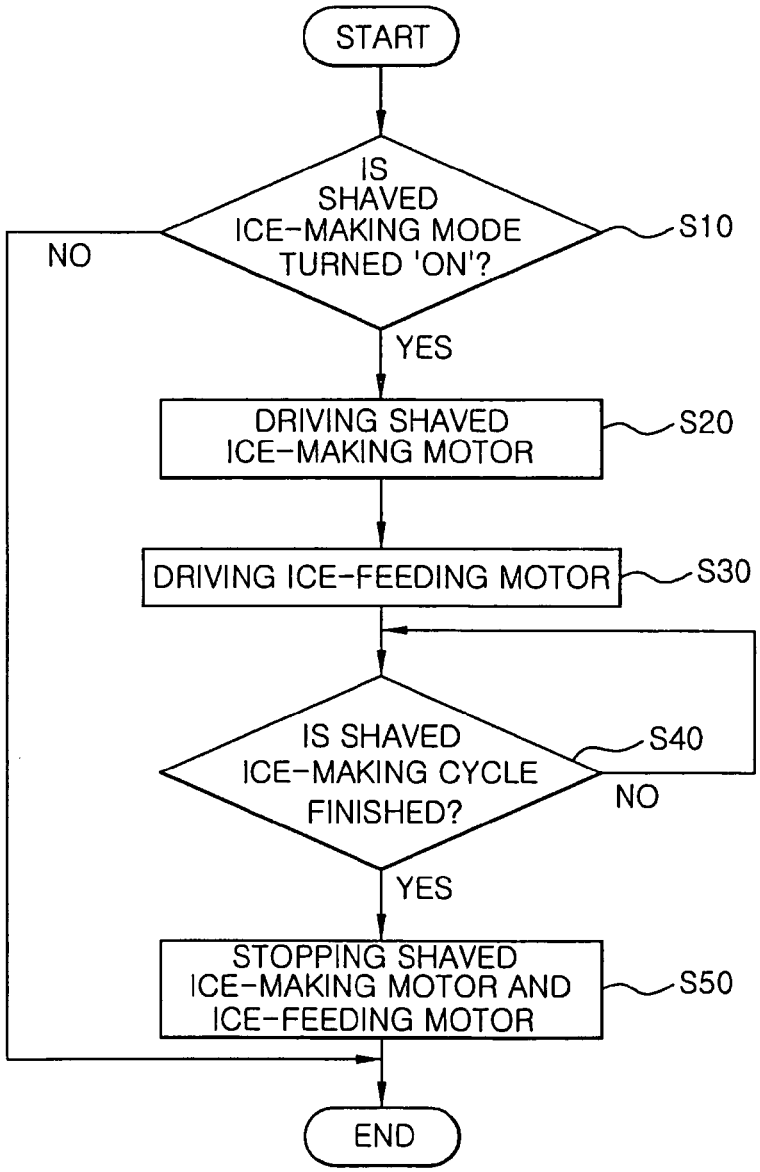
FIG. 1 (PRIOR ART)
FIG. 1 is a flow chart illustrating a conventional method of making shaved ice.
Figure 2:
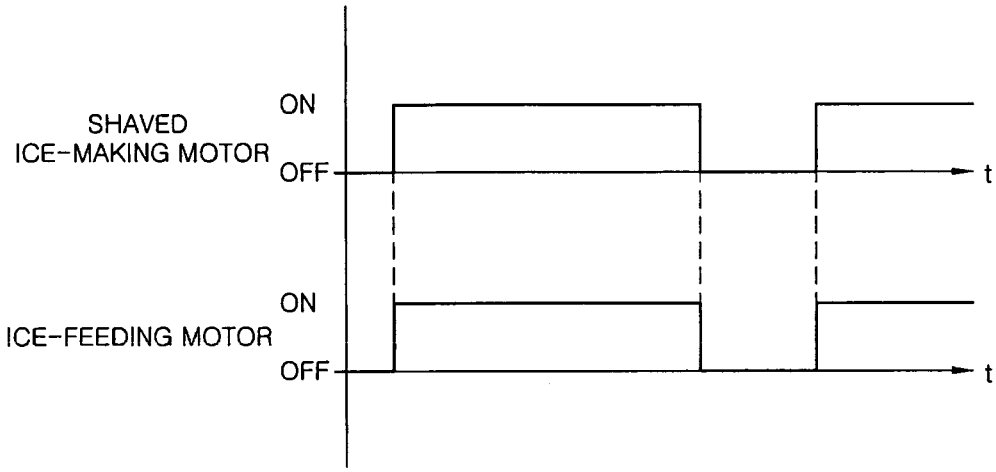
FIG. 2 (PRIOR ART)
FIG. 2 is a graph respectively illustrating driving time for a shaved ice-making motor and an ice-feeding motor according to the conventional art.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 3:
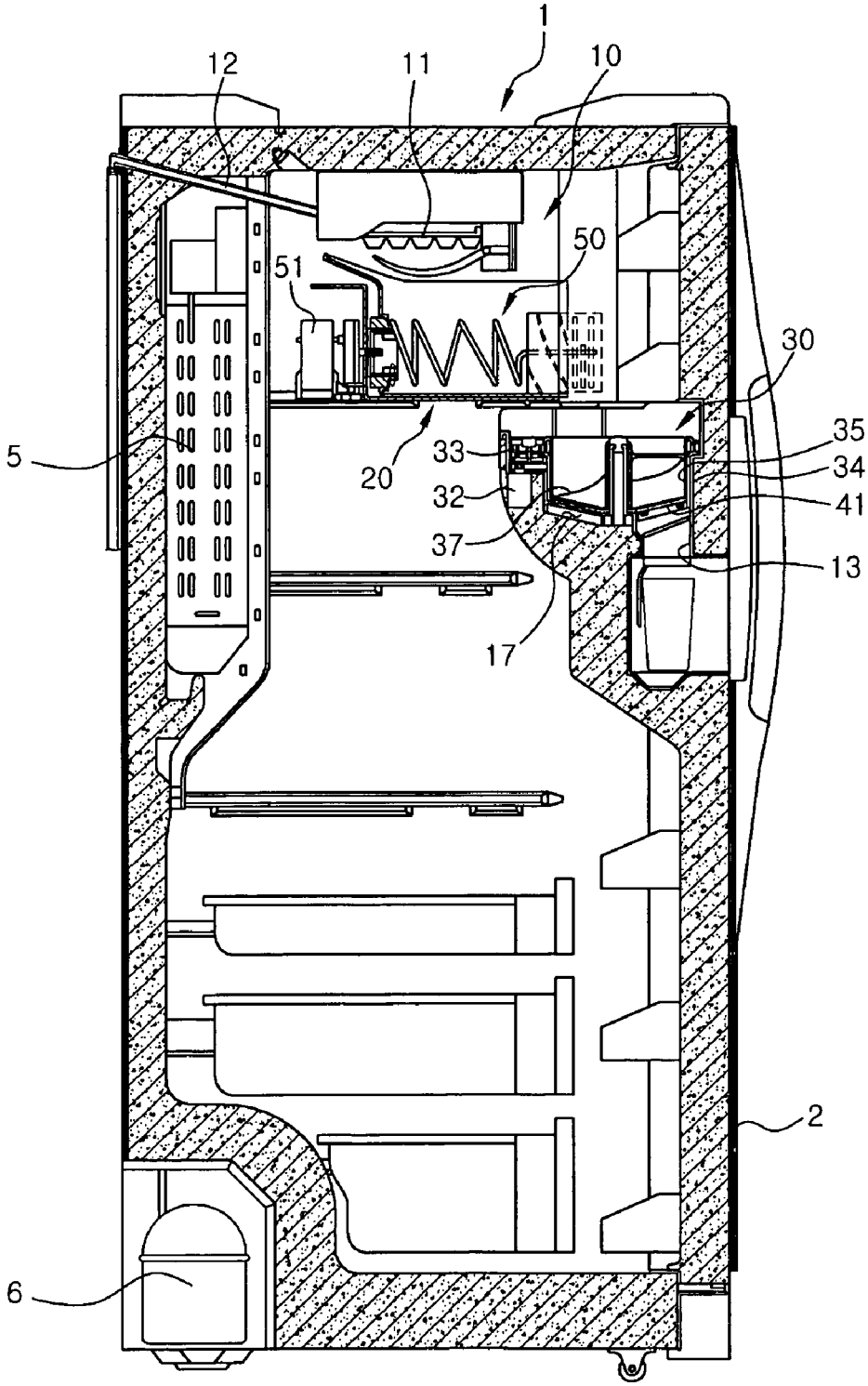
FIG. 3 is a sectional view schematically illustrating an inner structure of a refrigerator according to an embodiment of the present invention.
Figure 4:
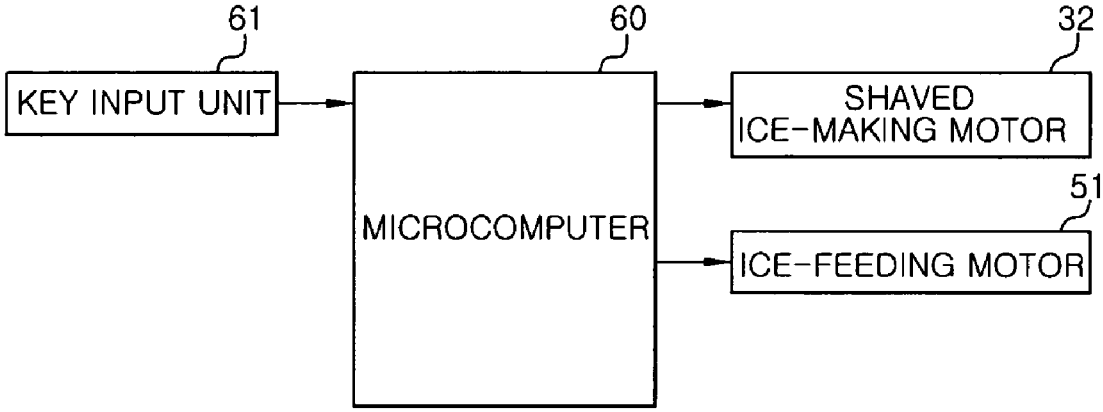
FIG. 4 is a block diagram illustrating components of the refrigerator shown in FIG. 3.

In FIGS. 3 and 4, a refrigerator according to the present invention comprises a housing 1 having an open front part, a freezing compartment door 2 and a refrigerating compartment door (not shown) hinged to the open front part of the housing 1. The housing 1, the freezing compartment door 2, and the refrigerating compartment door together form the external appearance of the refrigerator. In the housing 1 are partitioned a freezing compartment 4 and a refrigerating compartment (not shown), which are opened/closed by means of the freezing compartment door 2 and the refrigerating compartment door.

To the rear wall of the housing 1 is mounted an evaporator 5 to generate cool air. At the lower rear part of the housing 1 is disposed a compressor 6 to compress refrigerant. At the upper part of the freezing compartment 4 is disposed an automatic ice shaver 10 to automatically make and feed cubed ice of a predetermined size.

The automatically ice shaver 10 comprises an ice-making container 11 to make ice with water supplied to the ice-making container 11, an ice-storing container 20 disposed below the ice-making container 11 to store cubed ice made at the ice-making container 11, and a water-supplying pipe 12 connected to an external water-supplying source (not shown) and extending above the ice-making container 11 to supply water necessary to make ice to the ice-making container 11.

To the freezing compartment door 2 is mounted a shaved ice-making unit 30 to make the cubed ice fed from the ice-storing container 20 into shaved ice and supply the shaved ice. At the freezing compartment door 2 are formed a recess 17 where the shaved ice-making unit 30 is disposed, and a shaved ice-discharging port 13. At the ice-storing container 20 is disposed a cubed ice-feeding unit 50 to feed the cubed ice to the shaved ice-making unit 30. At the rear of the cubed ice-feeding unit 50 is mounted an ice-feeding motor 51 to drive the cubed ice-feeding unit 50.

When a predetermined time period elapses after water is filled in the ice-making container 11 through the water-supplying pipe 12, the water in the ice-making container 11 is frozen into cubed ice by means of cool air circulating in the freezing compartment 4. The cubed ice is automatically fed to the ice-storing container 20.

When a user inputs a shaved ice-making signal, the ice-feeding unit 50 and the shaved ice-making unit 30 are operated such that shaved ice is discharged out of the freezing compartment door through the shaved ice-discharging port 13.

The ice-feeding unit 50 is connected to the ice-feeding motor 51, which is mounted at one end of the ice-storing container 20, to feed the cubed ice stored in the ice-storing container 20 to the shaved ice-making unit 30 disposed at the freezing compartment door.

Specifically, the shaved ice-making unit 30 is disposed inside the freezing compartment door. The shaved ice-making unit 30 comprises a shaved ice-making motor 32 fixed to the recess 17, which communicates with the shaved ice-discharging port 13, while being disposed at the outside inner space of the freezing compartment door a reduction gear assembly 33 disposed above the shaved ice-making motor 32, a case 34 fixedly fitted in the inner space of the freezing compartment door, and a rotary tub 35 rotatably disposed in the case 34.

The reduction gear assembly 33, which is connected to the shaved ice-making motor 32 via a shaft, comprises a plurality of reduction gears (not shown), which are engaged with each other for properly reducing the rotation speed of the shaved ice-making motor 32.

The rotary tub 35, which has open upper and lower ends, is provided at the inner circumference thereof with a spiral wing 37. To the bottom of the case 34, in which the rotary tube 35 is rotatably fitted, is fixed a cutting blade 41, which cooperates with the spiral wing 37 such that the spiral wing 37 is rotated to make shaved ice.

As shown in FIG. 4, the refrigerator according to the present invention further comprises a key input unit 61 to allow the user to select the amount of shaved ice to be made or a predetermined time period for which the shaved ice is to be made and a control unit 60 to control various units of the refrigerator.

When a shaved ice-making signal is input to the control unit 60, the control unit 60 outputs a driving signal to the shaved ice-making motor 32 and the ice-feeding motor 51 such that the shaved ice-making motor 32 and the ice-feeding motor 51 are operated to make shaved ice. As the ice-feeding motor 51 is operated, cubed ice stored in the ice-storing container 20 is fed to the shaved ice-making unit 30 by means of the ice-feeding unit 50. When the cubed ice is introduced into the shaved ice-making unit 30, the cubed ice is shaved into shaved ice by means of the cutting blade 41 disposed at the bottom of the case 34 while being rotated in the rotary tube 35 by means of the spiral wing 37 formed at the rotary tube 35 as the shaved ice-making motor 32 is operated.

Figure 5:
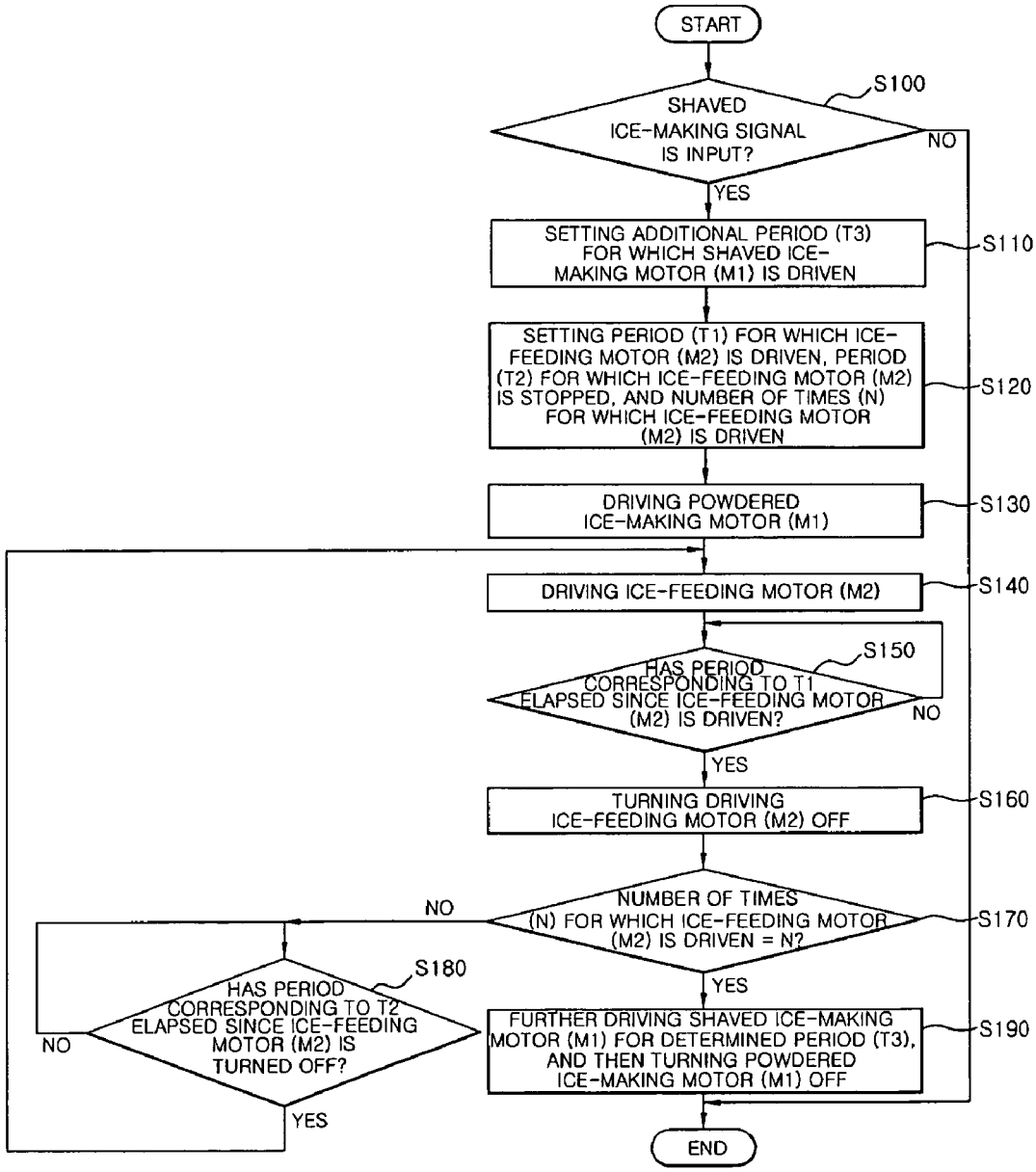
FIG. 5 is a flow chart illustrating a method of making shaved ice in the refrigerator shown in FIG. 4.

In this way, cubed ice fed by means of the ice-feeding motor 51 is made into shaved ice by means of the shaved ice-making motor 32. If the cubed ice is continuously fed to the shaved ice-making unit 30, the cubed ice in the shaved ice-making unit 30 is unnecessarily increased. As a result, the cubed ice may overflow the shaved ice-making unit 30, or the shaved ice-making unit 30 may be broken by the cubed ice. For this reason, driving time for the shaved ice-making motor 32 and the ice-feeding motor 51 is controlled as is shown in FIG. 5.

While the shaved ice-making motor 32 is operated for a predetermined period $T_{M1}$ after the shaved ice-making signal is input, the ice-feeding motor 51 is driven for a predetermined first reference period T1 such that cubed ice is fed to the shaved ice-making unit 30, and then the ice-feeding motor 51 is stopped for a predetermined second reference period T2 such that an appropriate amount of ice is fed to the shaved ice-making unit 30. Although the feed of the ice is interrupted for the second reference period, shaved ice is continuously made for the first reference period T1 and the second reference period T2. After the second period T2 elapses, the ice-feeding motor 51 is driven for the first period T1 such that cubed ice is fed to the shaved ice-making unit 30, and then the ice-feeding motor 51 is stopped for the second period T2 such that the cubed ice fed to the shaved ice-making unit 30 for the first period T1 is made into shaved ice. The above procedure is repeatedly carried out.

After the ice-feeding motor 51 is driven by a predetermined number of times N, the ice-feeding motor 51 is completely stopped. In this case, the shaved ice-making motor 32 is further operated for a predetermined third reference period T3 such that the cubed ice remaining in the shaved ice-making unit 30 is discharged out of the shaved ice-making unit 30.

The first reference period, the second reference period, the third reference period, and the number of times may vary depending on which mode the shaved ice is made in. The values are previously calculated on the basis of the corresponding mode, and stored in the control unit 60. For example, when a user pushes a one-serving selection button to make the shaved ice corresponding to one serving of ice water with red bean, the shaved ice-making motor 32 is driven for 52 seconds. At this time, the ice-feeding motor 51 is driven for 3 seconds (T1) and then stopped for 4 seconds (T2). This procedure is repeatedly carried out. Specifically, the ice-feeding motor 51 is repeatedly driven for 3 seconds (T1) by 8 times N, and is then repeatedly stopped for 4 seconds (T2) by 7 times. In this way, the ice-feeding motor 51 is repeatedly driven and stopped for 52 seconds. The shaved ice-making motor 32 is further operated for 4 seconds (T3) to made shaved ice.

Figure 6:
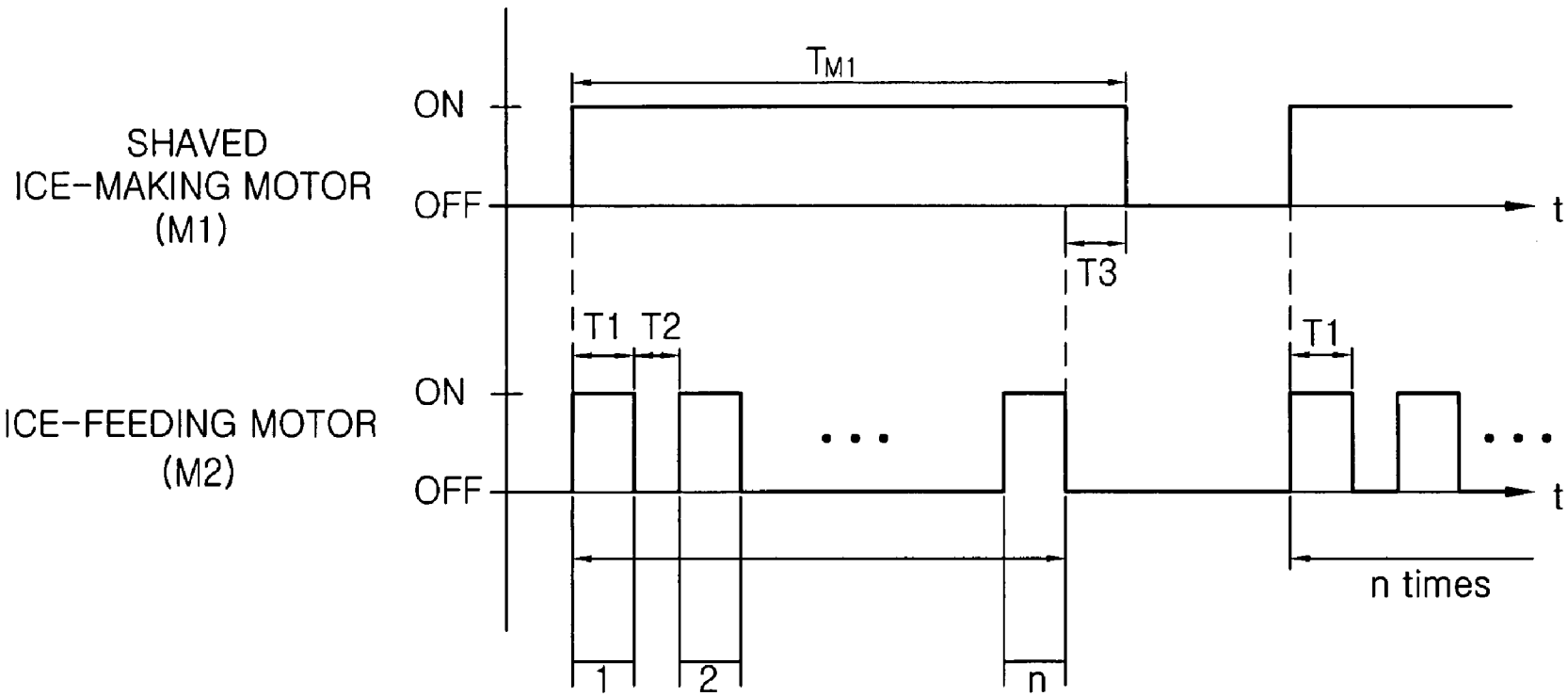
FIG. 6 is a graph respectively illustrating a driving time for a shaved ice-making motor and an ice-feeding motor according to an embodiment of the present invention.

Now, a method of making shaved ice in the refrigerator shown in FIG. 4 will be described with reference to FIGS. 5 and 6.

In FIG. 5, in operation 100, when a user selects a shaved ice-making mode using the key input unit 61, and then inputs a shaved ice-making signal, the control unit 60 determines whether the shaved ice-making signal is input through the key input unit 61.

When the shaved ice-making signal is input in operation 100, the process moves to operation 110 where the user sets the third reference period T3, for which the shaved ice-making motor 32 will be further operated, on the basis of the shaved ice-making mode. The set third period is transmitted to the shaved ice-making motor 32. From operation 110, the process moves to operation 120, where the first period T1, for which the ice-feeding motor 51 is driven, the second period T2, for which the ice-feeding motor 51 is stopped, and the number of times N, for which the ice-feeding motor 51 is driven, are set. The set first period, the set second period, and the set number of times are transmitted to the ice-feeding motor 51.

After the mode of controlling the shaved ice-making motor 32 and the ice-feeding motor 51 has been set in operations 110 and 120, the process moves to operation 130, where the shaved ice-making motor 32 is driven. At the same time, in operation 140, the ice-feeding motor 51 is also driven. As the shaved ice-making motor 32 and the ice-feeding motor 51 are driven, shaved ice is made according to the above shaved ice-making mode. From operation 140, the process moves to operation 150, where the control unit 60 determines whether the first period T1 has elapsed after the ice-feeding motor 51 is driven. When it is determined in operation 150, that the first period T1 has elapsed, the process moves to operation 160, where the ice-feeding motor 51 is stopped.

From operation 160, the process moves to operation 170, where the control unit 60 determines whether the ice-feeding motor 51 has been repeatedly driven by the predetermined number of times N. Since the ice-feeding motor 51 has been driven once, in operation 180, the microcomputer determines whether the second period T2 has elapsed after the ice-feeding motor 51 is stopped. After the ice-feeding motor 51 has been stopped for the second period T2, the ice-feeding motor 51 is driven again for first period T1. This procedure is repeatedly carried out.

After the ice-feeding motor 51 has been driven for the predetermined number of times N, the ice-feeding motor 51 is completely stopped, and from operation 170, the process moves to operation 190, where the shaved ice-making motor 32 is further driven for the third period T3 such that the cubed ice remaining in the shaved ice-making unit 30 is made into shaved ice and then the shaved ice is discharged out of the shaved ice-making unit 30.

As apparent from the above description, the ice-feeding unit is repeatedly driven and stopped to prevent ice from being excessively fed into the shaved ice-making unit. Consequently, the present invention has the effect of preventing ice from overflowing the shaved ice-making unit and preventing the shaved ice-making unit from being broken.

Furthermore, the shaved ice-making motor is further driven after the cubed ice-feeding unit is stopped to minimize the amount of ice left in the shaved ice-making unit. Consequently, the present invention has the effect of preventing the ice left in the shaved ice-making unit from massing into a lump, or preventing the ice left in the shaved ice-making unit from thawing into water, which may drop out of the refrigerator.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of making shaved ice comprising feeding cubed ice stored in an ice-storing unit mounted in a freezing compartment to a shaved ice-making unit mounted at a discharge port side of the ice-storing unit though an ice-feeding unit to make shaved ice, the method further comprising:

setting a driving time for the shaved ice-making unit;

setting a driving time for the ice-feeding unit, wherein the driving time for the shaved ice-making unit is longer than the driving time for the ice-feeding unit; and repeatedly driving and stopping the ice-feeding unit while driving the shaved ice-making unit continuously.

2. The method according to claim 1, further comprising performing a controlling operation such that the ice-feeding unit is stopped earlier than the shaved ice-making unit.

3. The method according to claim 2, further comprising further driving the shaved ice-making unit for a predetermined period after the ice-feeding unit is stopped.

4. The method according to claim 1, further comprising driving the ice-feeding unit for a predetermined first period, and then stopping for a predetermined second period, while driving the shaved ice-making unit continuously, thereby repeatedly driving and stopping the ice-feeding unit.

5. The method according to claim 4, further comprising further driving the shaved ice-making unit for a predetermined third period after the predetermined period elapses to make cubed ice.

6. The method according to claim 1, further comprising stopping the ice-feeding unit after the ice-feeding unit is driven for a predetermined number of times.

7. The method according to claim 6, further comprising further driving the shaved ice-making unit for a predetermined third period after the predetermined period elapses to make cubed ice.

8. A method of making shaved ice comprising feeding cubed ice stored in an ice-storing unit mounted in a freezing compartment to a shaved ice-making unit mounted at a discharge port side of the ice-storing unit though an ice-feeding unit to make shaved ice, the method further comprising:

driving the shaved ice-making unit for a predetermined period; and controlling the ice-feeding unit such that the ice-feeding unit is repeatedly driven and stopped for the predetermined period.

9. The method according to claim 8, further comprising driving the ice-feeding unit for a predetermined first period, and then stopping for a predetermined second period, while driving the shaved ice-making unit, thereby repeatedly driving and stopping the ice-feeding unit for the predetermined period.

10. The method according to claim 9, further comprising immediately stopping the ice-feeding unit, without stopping the ice-feeding unit for the predetermined second period, after the ice-feeding unit is driven for a predetermined number of times.

11. A refrigerator comprising:

an ice shaver mounted in a freezing compartment to make ice;

an ice-storing unit to store the ice made by the ice shaver;

an ice-feeding unit to feed the ice stored in the ice-storing unit to the outside of the ice-storing unit;

a shaved ice-making unit to receive the ice from the ice-feeding unit and to make the ice into shaved ice; and a control unit to perform a controlling operation such that the shaved ice-making unit is driven for a longer period than the ice-feeding units, wherein the control unit performs a controlling operation such that the ice-feeding unit is driven for a predetermined first period, and is then stopped for a predetermined second period, while the shaved ice-making unit is driven, the ice-feeding unit being repeatedly driven and stopped.

12. The refrigerator according to claim 11, wherein the control unit performs a controlling operation such that the ice-feeding unit is stopped earlier than the shaved ice-making unit.

13. The refrigerator according to claim 11, wherein the control unit drives the shaved ice-making unit for a predetermined period, drives the ice-feeding unit for a predetermined first period, and then stops the ice-feeding unit for a predetermined second period, the ice-feeding unit being repeatedly driven and stopped for the predetermined period, and further drives the shaved ice-making unit for a predetermined third period after the predetermined period elapses.

* * * * *

UNITED STATES PATENT AND TRADEMARK OFFICE

CERTIFICATE OF CORRECTION

PATENT NO. : 7,340,905 B2
APPLICATION NO. : 11/235292
DATED : March 11, 2008
INVENTOR(S) : Jae Koog An It is certified that error appears in the above-identified patent and that said Letters Patent is hereby corrected as shown below:

Column 8, Line 53, change “units,” to --unit,--.

Signed and Sealed this

Twenty-ninth Day of July, 2008

JON W. DUDAS
*Director of the United States Patent and Trademark Office*